United States Patent [19]

Provi

[11] 4,352,381

[45] Oct. 5, 1982

[54] TOOL HEAD AND HANDLE INTERCONNECTION

[75] Inventor: Michael A. Provi, Rockford, Ill.

[73] Assignee: Dasco Products, Inc., Rockford, Ill.

[21] Appl. No.: 181,090

[22] Filed: Aug. 25, 1980

[51] Int. Cl.[3] ..... B25G 3/34; B21H 7/06

[52] U.S. Cl. ..... 145/2 R; 76/103; 145/29 R

[58] Field of Search ..... 76/103; 145/29 R, 2 R, 145/29 A, 29 B, 29 C, 29 D, 36; 403/11, 12, 13, 25, 267, 268

[56] References Cited

U.S. PATENT DOCUMENTS

| | | | |
|---|---|---|---|
| 2,850,331 | 9/1958 | Curry et al. | 145/29 R |
| 3,018,140 | 1/1962 | Portz et al. | 403/268 |
| 3,355,226 | 11/1967 | Portz | 403/268 |
| 3,540,763 | 11/1970 | Yee . | |
| 3,552,787 | 1/1971 | Yee | 403/268 |
| 3,792,725 | 2/1974 | Burgeson | 145/29 R |
| 3,870,091 | 3/1975 | Burgeson | 145/29 R |
| 3,877,826 | 4/1975 | Shepherd | 145/29 R |
| 3,917,421 | 11/1975 | Carmien et al. | 145/29 R |
| 3,972,634 | 8/1976 | Carmien et al. | 145/29 B |

*Primary Examiner*—Roscoe V. Parker

*Attorney, Agent, or Firm*—Leydig, Voit, Osann, Mayer & Holt, Ltd.

[57] ABSTRACT

A tool such as a sledge or an axe is fastened on a handle by an adhesive which expands as it solidifies. A flexible sleeve is fitted on the handle and has a flange which is disposed at the lower end of the end portion of the handle that projects into the usual bore in the head. The flange closes the bottom of the bore and the sleeve includes an upwardly projecting extension which engages the lower end of the wall of the bore so that the flange and the extension locate the head properly on the handle in both the horizontal and vertical planes. The end portion of the handle which projects into the bore of the head is smaller in cross section than the bore to leave a space between this end portion and the wall of the bore and this space is filled with an adhesive which is liquid when it is poured into the base but which expands as it solidifies to provide a firm connection between the handle and the head. The flange on the sleeve serves the additional purpose of sealing the lower end of the bore in the head and thus holds the adhesive in the bore until the adhesive solidifies.

3 Claims, 6 Drawing Figures

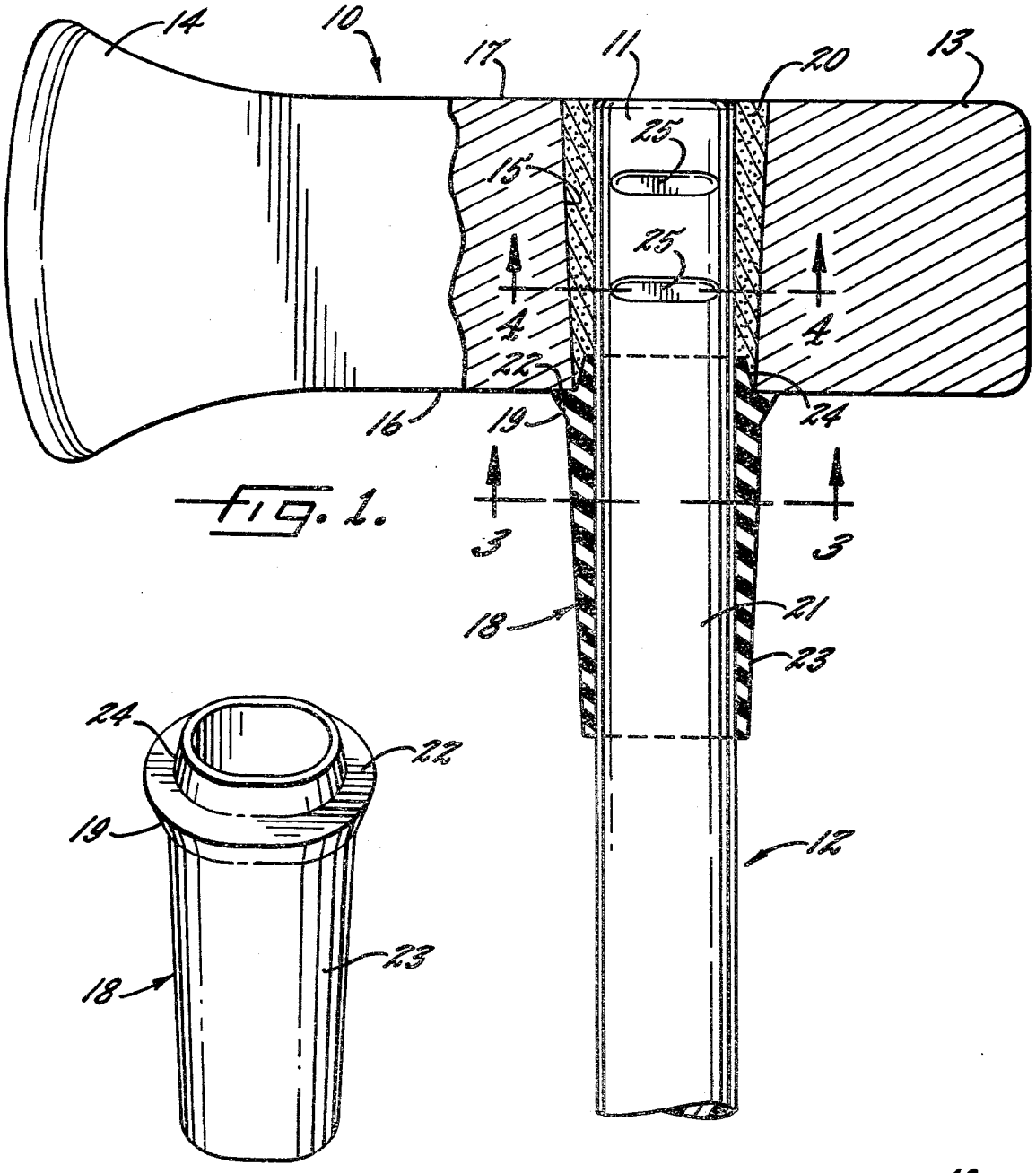
Fig. 1.
Fig. 2.
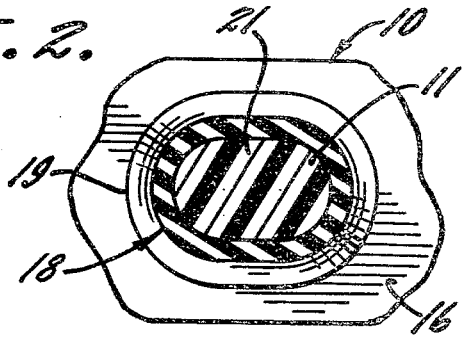
Fig. 3.
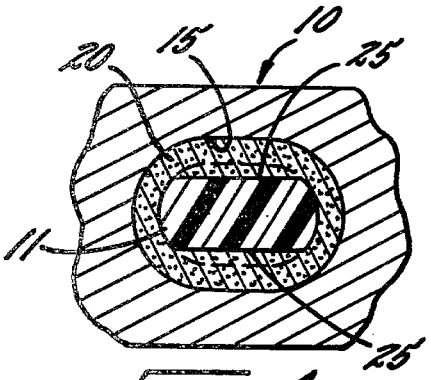
Fig. 4.

TOOL HEAD AND HANDLE INTERCONNECTION

BACKGROUND OF THE INVENTION

This invention relates to a means and a method for attaching the head of a tool such as a sledge, an axe or the like to a handle. Conventionally, the upper end of the handle is forced into a bore in the head and a wedge is driven into the upper end of the handle to expand the latter and secure the head to the handle. Usually, the handle is made of wood and may break in service use. Handles molded or protruded from materials such as fiberglass have been used but they have required special configurations which basically are applicable only to original equipment and are not easily used for both original equipment and replacement of a broken handle.

SUMMARY OF THE INVENTION

The principal object of the present invention is to provide both a novel means and a novel method for joining the head of the tool to the handle so that, whether the handle is original equipment or a replacement, the handle is easily fixed to the head with the head properly positioned on the handle in both the horizontal and vertical planes.

A more detailed object is to utilize a resilient sleeve which tightly encircles the handle and which accurately positions the head on the handle while sealing the lower end of the bore in the handle and to fill the space in the bore around the end portion of the handle with an adhesive which expands as it solidifies.

Another object is to form the sleeve in a novel manner so that the sleeve seals the bottom of the bore in the head to hold the adhesive while the latter sets and, at the same time, positions the head properly on the handle preparatory to filling the bore with the adhesive.

The invention also resides in the details of the construction of the sleeve and in the particular method of attaching the head to the handle.

BRIEF DESCRIPTION OF THE DRAWINGS

FIG. 1 is a fragmentary side view of a tool incorporating the novel features of the present invention, parts being broken away and shown in section.

FIG. 2 is a perspective view of the sleeve utilized in the invention.

FIG. 3 is a sectional view taken along the line 3—3 in FIG. 1.

FIG. 4 is a sectional view taken along the line 4—4 in FIG. 1.

DETAILED DESCRIPTION OF THE PREFERRED EMBODIMENTS

Figure 5:
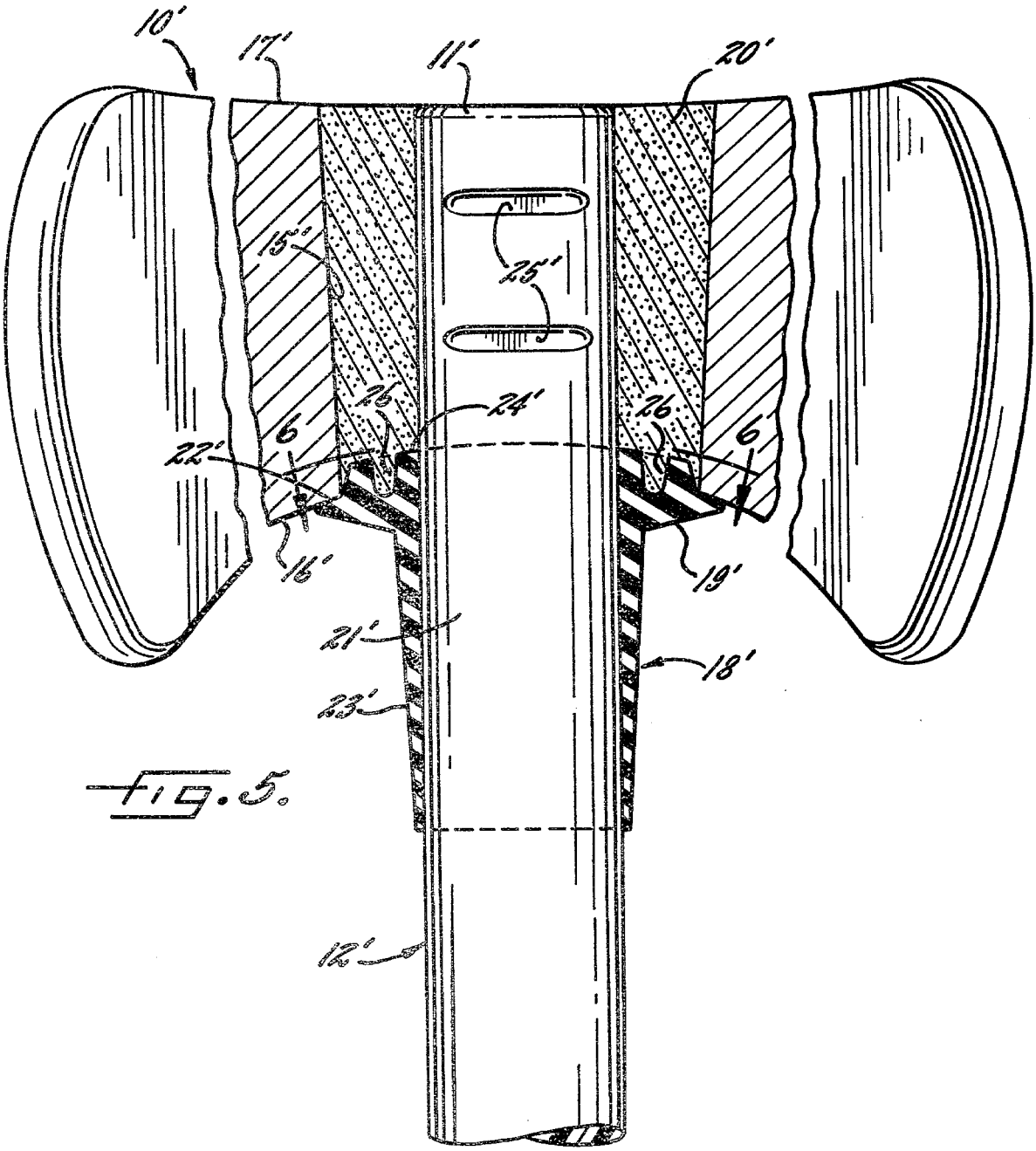
FIG. 5 is a view similar to FIG. 1 but showing a modified form of the invention.

As shown in the drawings for purposes of illustration, the invention is embodied in a tool such as a sledge (FIG. 1) having a metal head 10 secured to one end portion 11 of an elongated handle 12. The head 10 may include a squared hammer end portion 13 and, at the other end, a sharpened blade or axe portion 14. Between its ends, the head is formed with a bore 15 which extends through the head from the under side 16 to the upper side 17 of the head. The end portion 11 of the handle projects into the bore 15 and is fixed to the head. The handle 12 may be made of any suitable material but preferably is either molded or protruded of fiberglass or the like.

The present invention contemplates a novel means and method for attaching the head 10 to the handle 12 so that the head is easily and properly placed on the handle in both the horizontal and vertical planes whether the head is originally attached to the handle or is replaced on a new handle. This means includes a resilient sleeve 18 tightly encircling the handle immediately below the end portion 11 with an outwardly projecting flange 19 covering the bottom of the bore 15 and an expanding adhesive 20 filling the bore around the end portion 11, the latter being smaller than the bore. Thus, the head 10 is attached to the handle 12 first by stretching the sleeve 18 over the handle and locating the sleeve on the handle so that the flange 19 is at the bottom of the end portion 11. The head then is slipped over the end portion 11 so that it rests on the flange 19 and the flange and the sleeve thereby position the head properly relative to the handle in both the horizontal and vertical planes. Finally, the liquid adhesive 20 which expands as it solidifies is poured into the bore 15 through the upper end thereof until it fills the space between the end portion 11 and the well of the bore, the flange 19 retaining the adhesive in the bore. As the adhesive sets or solidifies, it expands thereby securely fastening the head in the proper position on the handle.

In the form shown in FIGS. 1 through 4, the bore 15 of the head 10 is generally oval in shape and the end portion 11 of the handle 12 is smaller in cross section and is similarly shaped although the shapes may be different so long as there is a space between the end portion and the wall of the bore with the space preferably extending completely around the end portion. The latter projects a substantial distance into the bore and, herein, the end portion extends the full length of the bore.

The sleeve 18 is molded of a resilient and flexible material such as vinyl or rubber and its natural internal diameter is somewhat less than the cross section of the handle portion 21 below the end portion 11 so that the sleeve is stretched when it is placed on the handle 12 and its resiliency holds it in position on the handle. Preferably, the sleeve is two or three inches long and the flange 19 is formed on the sleeve adjacent the upper end thereof. Although the sleeve may be molded with a circular shape, it is preferred to give it a shape generally corresponding to the cross section of the handle but, in any event, when the sleeve is in position on the handle, it as well as the flange generally assume the shape of the cross section of the handle. The upper surface 22 of the flange faces axially upwardly to engage the underside 16 of the head and is sized to extend beyond the wall of the bore 15 around the entire periphery thereof to overlap a substantial portion of the underside of the head completely around the bore. Below the surface 22, the flange tapers inwardly to the main body 23 of the sleeve and, herein, the body also tapers inwardly from the top to the bottom.

Above the flange 19 is an upwardly projecting extension 24 molded as an integral part of the sleeve 18 with a natural internal diameter the same as the natural internal diameter of the sleeve. The extension 24 tapers upwardly and inwardly and the outer dimension of the base of the extension is at least equal to and preferably slightly larger than the dimension of the bore 15. Thus, the extension projects into the bore and its base engages the wall of the bore around the entire periphery thereof, the base of the extension preferably being compressed slightly by the bore wall to hold the end portion 11 of the handle 12 centered in the bore.

With the foregoing arrangement, the sleeve 18 is stretched and slipped onto the handle 12 and then the sleeve is positioned on the handle so that the upper surface 22 of the flange 19 is at the lower end of the handle end portion 11. Next, this end portion is inserted in the bore 15 in the head 10 until the underside of the head engages the surface 22 of the flange 19. In this position of the head and the handle, the base of the sleeve extension 24 is compressed slightly by the wall of the bore. Thus, the surface 22 and the extension 24 cooperate to center the end portion 11 in the bore and to locate the head properly on the handle in both the horizontal and vertical planes. At the same time, the flange 19 completely seals the lower end of the bore. Finally, the space between the end portion 11 of the handle and the wall of the bore is filled with the adhesive 20. As stated above, the adhesive is liquid when it is poured into the bore and expands as it solidifies to form a firm joint between the head and the handle. Any one of several well-known adhesives of this type may be used, an example of which is a urethane cement. To insure an even more solid connection between the handle and the head, the end portion 11 of the handle may include one or more transverse grooves 25 which are filled by the adhesive 20 so that the adhesive, in effect, forms a key between the end portion and the main body of the adhesive.

Figure 6:
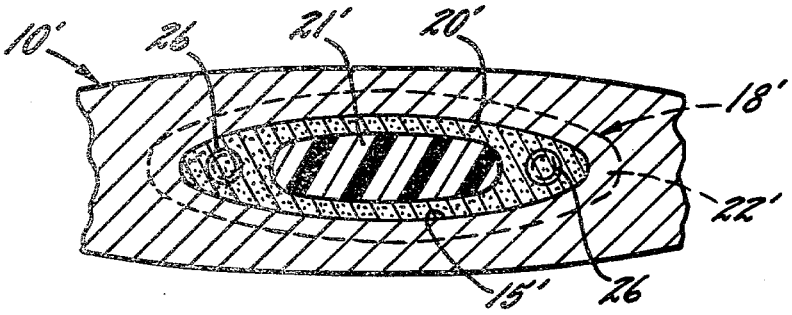
FIG. 6 is a fragmentary sectional view taken along the line 6—6 in FIG. 5.

In the form illustrated in FIGS. 5 and 6 in which corresponding and similar parts are indicated by the same but primed reference numerals, the head 10' is a double-edged axe blade and the bore 15' in the head is more elongated as shown in FIG. 6. For this application, the sleeve 18' is molded with generally the same configuration of the handle 12' but the flange 24' is elongated in the direction of the head 10'. In this instance, the upper surface 22' of the flange 19' faces generally upwardly but is bent downwardly slightly due to the curvature of the underside 16' of the head 10'. Because the bore 15' is larger in this embodiment, the extension 24' of the sleeve 18' is thicker in cross section and, to accommodate this in manufacturing, the extension may be cored as indicated at 26. In all other basic respects, the construction shown in FIGS. 5 and 6 is the same as that illustrated in FIGS. 1 through 4 and the method of assembling both embodiments is the same.

I claim:

1. In a tool having an elongated handle and a working head attached to one end portion of the handle, the combination of, a bore of preselected size extending through said head from the lower side thereof to the upper side, said end portion being smaller in cross section than said bore and projecting into said bore from said lower side of said head, a sleeve made of a resilient and flexible material and having a cross section generally similar to the cross section of said handle with the natural internal cross section of the sleeve being smaller than the cross section of said handle adjacent said end portion, said sleeve being stretched over said handle and disposed immediately below said end portion with the resiliency of the sleeve holding the latter in place on the handle, a flange formed on the upper end portion of said sleeve and having an upwardly facing surface engaging said lower side of said head and being larger than said bore around the entire periphery thereof to seal the lower end of the bore, an extension formed on said sleeve above said flange and projecting into said bore, said extension being tapered upwardly and inwardly from a base portion adjacent said surface on said flange with the natural cross section of said base portion being larger than the cross section of said bore and with the cross section of the upper portion of the extension being smaller than the cross section of the bore, said base portion of said extension being compressed as said head is placed on said end portion with the lower side of the head abutting said upwardly facing surface on said flange, said surface and said base portion of said extension cooperating to position said head properly on said handle in both the horizontal and vertical planes and to center said end portion in said bore, and an adhesive filling the space in said bore around said end portion of said handle.

2. In a tool as defined by claim 1 in which said adhesive initially is liquid and expands as it sets.

3. In a tool as defined by claim 2 in which said adhesive is a urethane cement.

* * * * *